US009156257B2

(12) United States Patent
Mizutani

(10) Patent No.: US 9,156,257 B2
(45) Date of Patent: Oct. 13, 2015

(54) RECORDING METHOD

(71) Applicant: CANON KABUSHIKI KAISHA, Tokyo (JP)

(72) Inventor: Michinari Mizutani, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 112 days.

(21) Appl. No.: 13/782,354

(22) Filed: Mar. 1, 2013

(65) Prior Publication Data

US 2013/0229461 A1 Sep. 5, 2013

(30) Foreign Application Priority Data

Mar. 2, 2012 (JP) ..... 2012-046423

(51) Int. Cl.

| | |
|---|---|
| ***B41J 2/14*** | (2006.01) |
| ***B41J 2/15*** | (2006.01) |
| ***B41J 2/135*** | (2006.01) |
| ***B41J 2/21*** | (2006.01) |
| ***B41J 19/20*** | (2006.01) |

(52) U.S. Cl.

CPC ..... *B41J 2/135* (2013.01); *B41J 2/1404* (2013.01); *B41J 2/15* (2013.01); *B41J 2/2125* (2013.01); *B41J 19/202* (2013.01); *B41J 2202/09* (2013.01); *B41J 2202/11* (2013.01)

(58) Field of Classification Search

CPC ..... B41J 2/04503

See application file for complete search history.

(56) References Cited

U.S. PATENT DOCUMENTS

| | | | | |
|---|---|---|---|---|
| 6,318,845 | B1 | 11/2001 | Mizutani | |
| 6,547,354 | B1 * | 4/2003 | Askeland et al. | 347/12 |
| 6,557,982 | B2 | 5/2003 | Murakami et al. | |
| 6,572,212 | B2 | 6/2003 | Konno et al. | |
| 6,789,877 | B2 * | 9/2004 | Murakami et al. | 347/40 |
| 7,360,853 | B2 * | 4/2008 | Barss | 347/8 |
| 7,708,365 | B2 * | 5/2010 | Yamanaka et al. | 347/12 |
| 2006/0055714 | A1 * | 3/2006 | Kuwahara et al. | 347/5 |
| 2010/0149258 | A1 * | 6/2010 | Mizutani | 347/43 |

FOREIGN PATENT DOCUMENTS

JP 2002-154208 A 5/2002

* cited by examiner

*Primary Examiner* — Stephen Meier
*Assistant Examiner* — Renee I Wilson
(74) *Attorney, Agent, or Firm* — Fitzpatrick, Cella, Harper & Scinto

(57) ABSTRACT

Provided is a recording method for performing recording by ejecting liquid to a recording medium, the recording method including: preparing a liquid ejection head including an ejection orifice array in which multiple ejection orifices for ejecting the liquid are arranged; and ejecting multiple liquid droplets from the multiple ejection orifices while the recording medium and the liquid ejection head are relatively moved at a speed of 40 inch/s or more to fill a predetermined pixel area on the recording medium with the multiple liquid droplets. A relationship $A/12 \leq b \leq 25-A/5$ is satisfied, where A (inch/s) represents the speed of the relative movement and b (pl) represents an amount of a liquid droplet ejected by one ejection.

14 Claims, 11 Drawing Sheets

RECORDING METHOD

BACKGROUND OF THE INVENTION

1. Field of the Invention

The present invention relates to a recording method for performing recording by ejecting a liquid droplet such as an ink droplet from multiple ejection orifices of a liquid ejection head.

2. Description of the Related Art

An ink jet recording apparatus is a recording apparatus which can output a high-quality letter or image at low cost. As an example, an air bubble generated when a pulse signal is input to an electrothermal converter causes a liquid droplet of black ink or a liquid droplet of color ink of cyan, magenta, yellow, or the like to be ejected from an ejection orifice.

Black ink is often used for, in addition to recording of letters and the like, solid filling of an entire surface of a predetermined region, that is, so-called solid printing. When solid printing is performed by ejecting minute liquid droplets, the number of the ejection times tends to be large and the time required for the recording tends to be long. Therefore, there has been proposed a liquid ejection head in which a liquid droplet of black ink is formed so as to be larger than a liquid droplet of color ink when ejected, which is disclosed in Japanese Patent Application Laid-Open No. 2002-154208.

In the liquid ejection head disclosed in Japanese Patent Application Laid-Open No. 2002-154208, by increasing the moving speed of a carriage having a liquid ejection head mounted thereon, the speed of ink jet recording including the above-mentioned solid printing can be further increased. However, there is a high risk that high-speed movement of the carriage involves image quality deterioration. Generally, a liquid droplet ejected from an ejection orifice includes a main droplet and an accompanying satellite. As the moving speed of the carriage becomes higher, the travelling distance of the carriage from the impact of a main droplet on a medium surface to the impact of its satellite on the medium surface becomes larger. Therefore, there is a tendency that, as the moving speed of the carriage becomes higher, the distance between a main droplet and its satellite becomes larger. As a result, a satellite impacts away from the main droplet which forms a letter, and thus, the image quality at the edge of the letter is conspicuously deteriorated. In the following, defected impact at the edge is described with reference to FIGS. 10A to 10G and FIGS. 11A and 11B. FIGS. 10A to 10G illustrate states from the ejection of an ink droplet to the impacts of the ink droplet on a recording medium. FIGS. 11A and 11B illustrate image quality deterioration involved in high-speed movement of a carriage. FIG. 10A illustrates a state immediately after a main droplet 110 and a satellite 120 are ejected from an ejection orifice 10. FIGS. 10B and 10C illustrate states in which the main droplet 110 and the satellite 120 impact on a recording medium 15 when the moving speed of the carriage is 25 inch/s (0.635 m/s). FIG. 10D illustrates the main droplet 110 and the satellite 120 illustrated in FIG. 10C seen from above. FIGS. 10E and 10F illustrate states in which the main droplet 110 and the satellite 120 impact on the recording medium 15 when the moving speed of the carriage is 40 inch/s (1.016 m/s) or more. FIG. 10G illustrates the main droplet 110 and the satellite 120 illustrated in FIG. 10F seen from above. The ink droplet ejected from the ejection orifice 10 toward the recording medium 15 is divided into the main droplet 110 and multiple satellites 120*a* and 120*b* (see FIGS. 10B and 10E). After that, the ink droplet impacts on the recording medium 15 separately as the main droplet 110 and one large satellite 120 which is an aggregation of the multiple satellites 120*a* and 120*b* (see FIGS. 10C and 10F). The impact deviation in position of the satellite 120 from the main droplet 110 is caused by the movement of the carriage. When the moving speed of the carriage is about 25 inch/s (0.635 m/s) as in a conventional case, as illustrated in FIG. 10D, an impact deviation L is small and no problem is presented. On the other hand, when the moving speed of the carriage is 40 inch/s (1.016 m/s) or more, as illustrated in FIG. 10G, the impact deviation L becomes larger. Therefore, a non-image area is formed between an area on which the main droplet 110 impacts and an area on which the satellite 120 impacts. The non-image area is recognized more as a lack of sharpness of letter quality, that is, roughness of edges 51, as the area of white, which is the color of the medium surface, becomes larger (see FIGS. 11A and 11B).

Therefore, conventionally, it has been difficult to accomplish high-speed recording and high-quality recording at the same time.

SUMMARY OF THE INVENTION

There is provided a recording method for performing recording by ejecting liquid to a recording medium, the recording method including:

preparing a liquid ejection head including an ejection orifice array in which multiple ejection orifices for ejecting the liquid are arranged; and ejecting multiple liquid droplets from the multiple ejection orifices while the recording medium and the liquid ejection head are relatively moved at a speed of 40 inch/s or more to fill a predetermined pixel area on the recording medium with the multiple liquid droplets.

In this recording method, a relationship $A/12 \leq b \leq 25-A/5$ is satisfied, where A (inch/s) represents the speed of the relative movement and b (pl) represents an amount of a liquid droplet ejected by one ejection.

Further, there is provided a recording method for performing recording by ejecting liquid to a recording medium, the recording method including:

preparing a liquid ejection head including an ejection orifice array in which multiple ejection orifices for ejecting the liquid are arranged; and ejecting multiple liquid droplets from the multiple ejection orifices while the recording medium and the liquid ejection head are relatively moved at a predetermined speed to fill a pixel area on the recording medium with the multiple liquid droplets, the pixel area being defined by a lattice corresponding to 600 dpi.

In this recording method, a relationship $A/12 \leq b \leq 25-A/5$ is satisfied, where A (inch/s) represents the predetermined speed of the relative movement and b (pl) represents an amount of a liquid droplet ejected by one ejection.

Further, there is provided a recording method for performing recording by ejecting liquid to a recording medium, the recording method including:

preparing a liquid ejection head including an ejection orifice array in which multiple ejection orifices for ejecting the liquid are arranged; and ejecting multiple liquid droplets from the multiple ejection orifices while the recording medium and the liquid ejection head are relatively moved at a predetermined speed to fill a predetermined pixel area on the recording medium with the multiple liquid droplets.

In this recording method, a total amount of the multiple liquid droplets which fill the predetermined pixel area is 20 pl or more.

And a relationship $A/12 \leq b \leq 25-A/5$ is satisfied, where A (inch/s) represents the predetermined speed of the relative movement and b (pl) represents an amount of a liquid droplet ejected by one ejection.

Further features of the present invention will become apparent from the following description of exemplary embodiments with reference to the attached drawings.

DESCRIPTION OF THE EMBODIMENTS

Figure 1A:
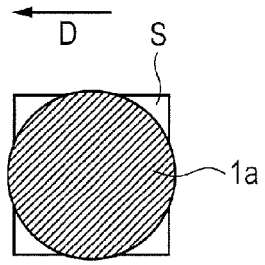
FIGS. 1A, 1B, 1C and 1D illustrate a liquid ejection recording method of an embodiment of the present invention in contrast with a conventional liquid ejection recording method.

FIGS. 1A to 1D illustrate a liquid ejection recording method of an embodiment mode of the present invention in contrast with a conventional liquid ejection recording method. FIG. 1A illustrates a state in which a liquid droplet impacts on a recording medium with use of the conventional liquid ejection recording method. In the following, description is given of a case of one-pass entire surface printing (solid printing) in which liquid droplets are continuously ejected from all ejection orifices.

In the conventional liquid ejection recording method, as illustrated in FIG. 1A, one liquid droplet 1*a* of ink or the like is ejected toward one pixel area S of a recording medium. In the ejection mode illustrated in FIG. 1A, the arrangement density of ejection orifices, which means the number of the ejection orifices per inch, is 600 dots per inch (dpi). Therefore, the one pixel area S is a unit lattice corresponding to 600 dpi. The length of one side of the one pixel area S is 42.33 μm, and the length of a diagonal line of the one pixel area S is 59.87 μm. Generally, in order to fill the one pixel area S with one liquid droplet, it is necessary to cause a liquid droplet, which has a dot diameter equal to or larger than the diagonal line of the one pixel area S, to impact on the recording medium. Therefore, an ejection amount which accomplishes a dot diameter of 59.87 μm or more under a state in which the liquid droplet bleeds on the recording medium is necessary. In the case of black ink, although depending on the physical properties of the ink to some extent, a specified amount necessary for filling the one pixel area S corresponding to 600 dpi is about 20 pl to about 30 pl. In FIG. 1A, the ejection amount of the liquid droplet 1*a* is 24 pl.

Figure 1B:
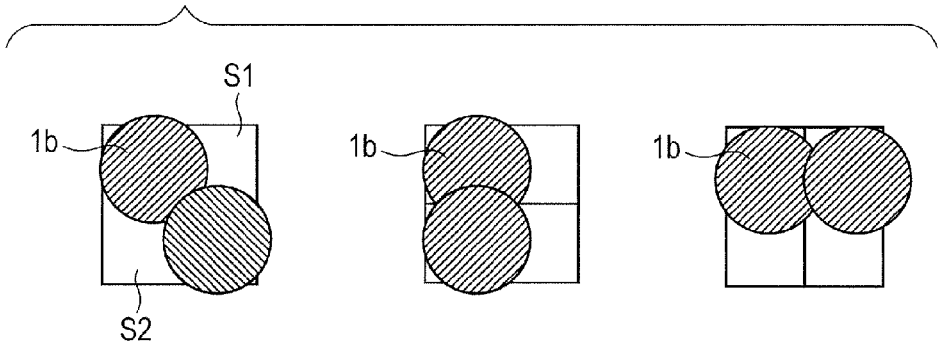
Figure 1C:
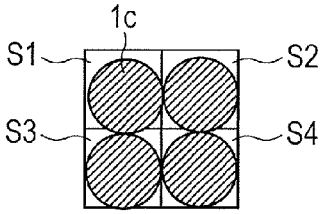
Figure 1D:
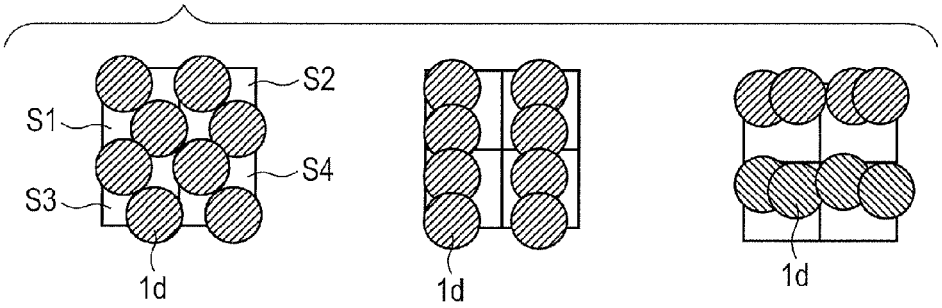

In the conventional ejection mode illustrated in FIG. 1A, when the carriage is moved at high speed of 40 inch/s (1.016 m/s) or more, the impact deviation of a satellite from a main droplet becomes large to deteriorate the image quality (see FIGS. 10A to 10G and FIGS. 11A and 11B). Therefore, according to the present invention, not one liquid droplet fills the one pixel area but multiple liquid droplets continuously ejected from ejection orifices fill the one pixel area. FIG. 1B illustrates a state in which liquid droplets 1*b* from two ejection orifices respectively impact on two ejection areas S1 and S2, which are divided areas of the one pixel area S. The ejection amount of each liquid droplet 1*b* is 12 pl so that the total amount of the two liquid droplets 1*b* is substantially equal to the ejection amount of the liquid droplet 1*a* illustrated in FIG. 1A. As illustrated in FIG. 1B, the two liquid droplets 1*b* may have a positional relationship of being adjacent to each other in a direction intersecting a scan direction D of the carriage (see FIG. 1A), a positional relationship of being adjacent to each other in a direction orthogonal to the scan direction D, or a positional relationship of being adjacent to each other in a direction in parallel with the scan direction D. FIG. 1C illustrates a state in which liquid droplets 1*c* from four ejection orifices respectively impact on four ejection areas S1 to S4, which are divided areas of the one pixel area S. The ejection amount of each liquid droplet 1*c* is 6 pl so that the total amount of the four liquid droplets 1*c* is substantially equal to the ejection amount of the liquid droplet 1*a* illustrated in FIG. 1A. FIG. 1D illustrates a state in which liquid droplets 1*d* from eight ejection orifices respectively impact on four ejection areas S1 to S4, which are divided areas of the one pixel area S. The ejection amount of each liquid droplet 1*d* is 3 pl so that the total amount of the eight liquid droplets 1*d* is substantially equal to the ejection amount of the liquid droplet 1*a* illustrated in FIG. 1A. In each of the ejection modes illustrated in FIG. 1B to FIG. 1D, the arrangement density of the ejection orifices is 1,200 dpi.

Figure 2:
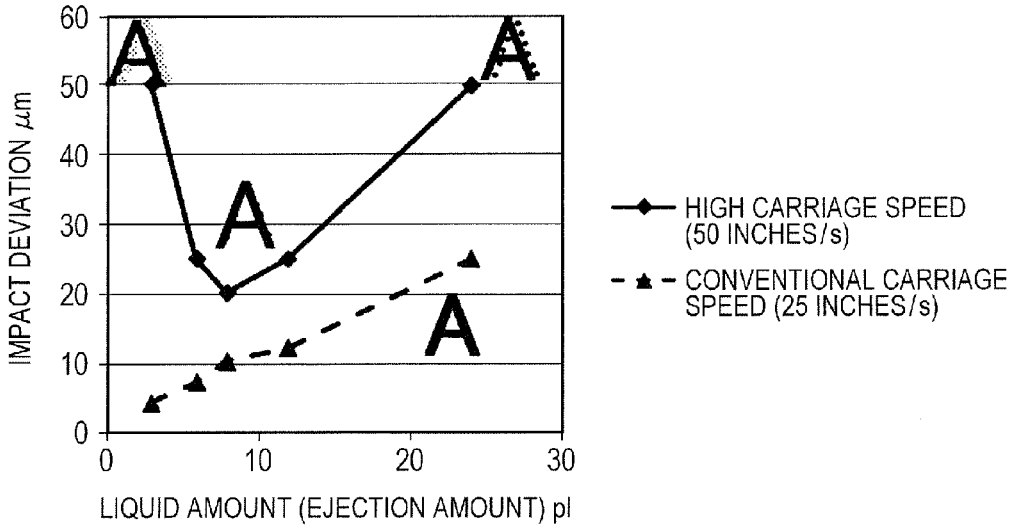
FIG. 2 is a graph showing the relationship between the ejection amount of a liquid droplet and the impact deviation of a satellite from a main droplet with regard to two moving speeds of a carriage.

FIG. 2 is a graph showing the relationship between the ejection amount of a liquid droplet and the impact deviation of a satellite from a main droplet with regard to two moving speeds of a carriage. In FIG. 2, the moving speeds of the carriage are 50 inch/s (1.27 m/s) and 25 inch/s (0.635 m/s). The impact deviation of a satellite is deviation in the scan direction of the carriage in one-pass entire surface printing. In FIG. 2, when the liquid amount is 20 pl or more, the arrangement density of the ejection orifices is 600 dpi. When the liquid amount is less than 20 pl, the arrangement density of the ejection orifices is 1,200 dpi. The flying speed of a liquid droplet is in a range of 12 to 15 m/s. The distance from the ejection orifices to the recording medium is 1.5 mm.

As shown in FIG. 2, when the moving speed of the carriage is 25 inch/s (0.635 m/s) and the ejection amount is 30 pl or less, the impact deviation of a satellite is half the length of one side of one pixel area corresponding to 600 dpi (42.3 μm) or less. On the other hand, when the moving speed of the carriage is 50 inch/s (1.27 m/s) and the ejection amount is in a range of 5 pl or more and 15 pl or less, the impact deviation of a satellite is 40 μm, which corresponds to the length of one side of one pixel area, or less. When the impact deviation of a satellite is larger than the length of one side of one pixel area, the image quality deterioration is conspicuous. Therefore, when the moving speed of the carriage is 50 inch/s (1.27 m/s), the image quality deterioration is inconspicuous when the liquid amount is at least in a range of 5 pl to 15 pl.

Figure 3A:
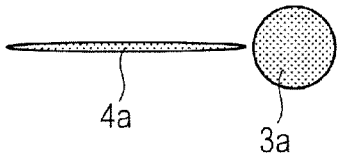
FIGS. 3A, 3B, 3C, 3D, 3E, 3F, 3G, 3H, 3I and 3J illustrate states of ejected main droplets and satellites when the ejection amount of a liquid droplet is changed.
Figure 3B:
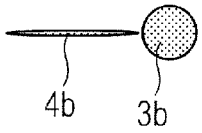
Figure 3C:
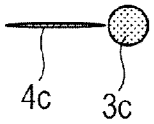
Figure 3D:
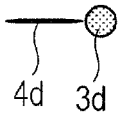
Figure 3E:
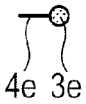
Figure 3F:
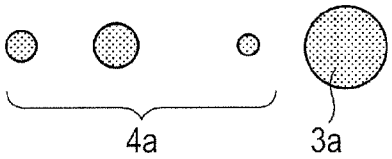
Figure 3G:
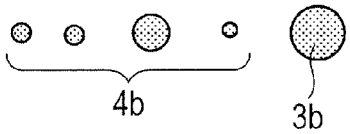
Figure 3H:
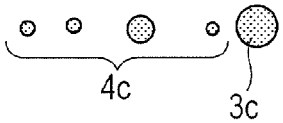
Figure 3I:
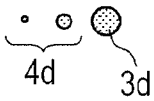
Figure 3J:
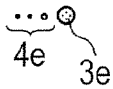
Figure 4A:
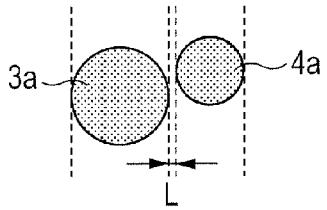
FIGS. 4A, 4B, 4C, 4D, 4E, 4F, 4G, 4H, 4I and 4J illustrate impact deviations of the satellites from the main droplets when the moving speed of the carriage is changed.
Figure 4F:
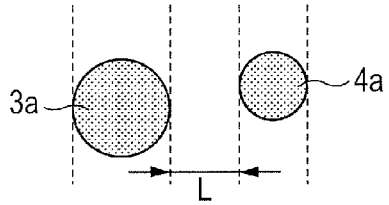
Figure 4B:
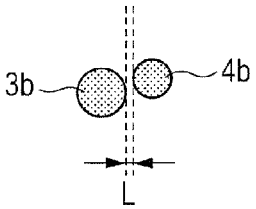
Figure 4G:
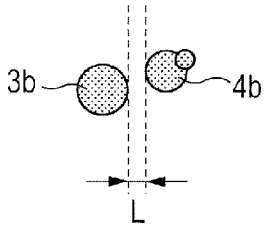
Figure 4C:
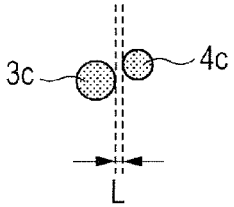
Figure 4H:
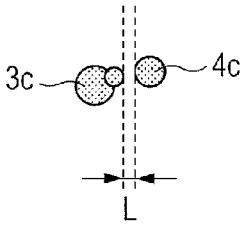
Figure 4D:
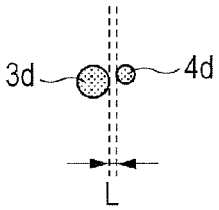
Figure 4I:
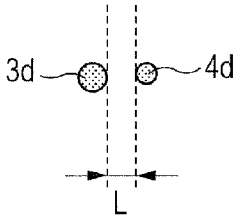
Figure 4E:
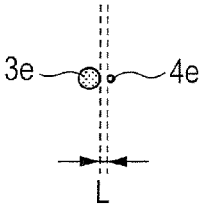
Figure 4J:
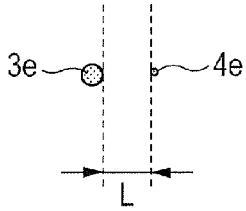

FIGS. 3A to 3J illustrate states of ejected main droplets and satellites when the ejection amount of a liquid droplet is changed. In FIGS. 3A to 3J, the left side is the ejection orifice side and the right side is the recording medium side. The ejection amount of a liquid droplet (a main droplet 3*a* and a satellite 4*a*) illustrated in FIG. 3A is 24 pl. The ejection amount of a liquid droplet (a main droplet 3*b* and a satellite 4*b*) illustrated in FIG. 3B is 12 pl. The ejection amount of a liquid droplet (a main droplet 3*c* and a satellite 4*c*) illustrated in FIG. 3C is 8 pl. The ejection amount of a liquid droplet (a main droplet 3*d* and a satellite 4*d*) illustrated in FIG. 3D is 6 pl. The ejection amount of a liquid droplet (a main droplet 3*e* and a satellite 4*e*) illustrated in FIG. 3E is 3 pl. FIGS. 3F to 3J illustrate states of the liquid droplets illustrated in FIGS. 3A to 3E during their falling down. The impact deviation of a satellite is greatly influenced by the positional relationship in the initial state between the main droplet and the satellite illustrated in FIG. 3A to FIG. 3E. In general, as the liquid amount becomes larger, the diameter of the ejection orifice is designed to be larger. In other words, there is a tendency that, as the diameter of the ejection orifice becomes larger, the length of a satellite becomes larger and the impact deviation of a satellite from a main droplet becomes larger.

FIGS. 4A to 4J illustrate impact deviations of the satellites with respect to the main droplets when the moving speed of the carriage is changed. FIGS. 4A to 4E illustrate impact deviations of the satellites when the moving speed of the carriage is 25 inch/s (0.635 m/s). FIGS. 4F to 4J illustrate impact deviations of the satellites when the moving speed of the carriage is 50 inch/s (1.27 m/s). The ejection amounts of the liquid droplets correspond to those in FIGS. 3A to 3E, respectively. As illustrated in FIGS. 4A to 4J, as the moving speed of the carriage becomes higher, the impact deviation of the satellite becomes larger. Therefore, the upper limit of the liquid amount necessary for inhibiting the impact deviation within the length of one side of one pixel area corresponding to 600 dpi was studied. As a result, the following relationship was found:

$$b \leq 25 - A/5,$$

where A represents the moving speed (inch/s) of the carriage and b represents the ejection amount (pl) of a liquid droplet.

The above-mentioned relationship was verified when the ejection velocity V of a liquid droplet was in a range of 5 to 20 m/s, the ejection velocity Vs of a satellite was in a range of 0.6V to 0.8V, and the distance from the ejection orifice to the recording medium was in a range of 0.5 to 3 mm.

There is a possibility that the impact deviation of a satellite is affected by airflow which flows in a space between the ejection orifice and the recording medium as the carriage moves. Further, the impact deviation of a satellite is thought to be determined by the balance between the magnitude of the above-mentioned flowing-in airflow and the force to move straight ahead against the airflow (kinetic energy of the satellite).

As illustrated in FIG. 1A, in the mode in which one liquid droplet in the ejection amount of 24 pl is ejected toward the one pixel area S, the impact deviation of a satellite is greatly affected by the moving speed of the carriage. On the other hand, as illustrated in FIG. 1D, in the mode in which eight liquid droplets each having an ejection amount of 3 pl are ejected toward the one pixel area S, the impact deviation of a satellite is greatly affected by the above-mentioned flowing-in airflow. Therefore, the lower limit of the liquid amount necessary for inhibiting the impact deviation within the length of one side of one pixel area corresponding to 600 dpi was studied. As a result, the following relationship was found:

$$b \geq A/12,$$

where A represents the moving speed (inch/s) of the carriage and b represents the ejection amount (pl) of a liquid droplet.

The above-mentioned relationship was verified when the ejection velocity V of a liquid droplet was in a range of 5 to 20 m/s, the ejection velocity Vs of a satellite was in a range of 0.6V to 0.8V, and the distance from the ejection orifice to the recording medium was in a range of 0.5 to 3 mm.

It is desired that the ejection amount b which satisfies the above-mentioned relationship be more than 3 pl. The reason is described in the following. When the liquid droplet of 6 pl illustrated in FIG. 3D and the liquid droplet of 3 pl illustrated in FIG. 3E are ejected, the satellites 4*d* and 4*e* are divided into impacting satellites which impact on the recording medium and floating satellites which float to be a mist without impacting. The ratio between the impacting satellites and the floating satellites is correlated with the liquid amount. With regard to the liquid droplet of 6 pl, the proportion of the impacting satellites is larger than the proportion of the floating satellites. On the other hand, with regard to the liquid droplet of 3 pl, the proportion of the floating satellites is larger than the proportion of the impacting satellites. When the ejection amount b no longer satisfies the above-mentioned relationship due to high-speed movement of the carriage, insufficient kinetic energy of the ejected satellites lowers the accuracy of the impact of the satellites to deteriorate the image quality. When the ejection amount b is 3 pl or less, the proportion of the floating satellites is larger than the proportion of the impacting satellites. As a result, the impact deviation of a satellite with respect to a main droplet becomes smaller, but another problem arises that the inside of the apparatus becomes dirty.

When the moving speed of the carriage is 50 inch/s (1.27 m/s) or less as illustrated in FIG. 4A to 4J, by ejecting multiple liquid droplets in the ejection amount of 6 pl, 8 pl, or 12 pl, the impact deviation of a satellite can be relatively small to maintain high quality of an image.

As described above, according to the liquid ejection recording method of this embodiment mode, multiple small liquid droplets are ejected in one pixel area. Therefore, even when the carriage is moved at high speed, the impact deviation of a satellite from a main droplet is inhibited within a range in which the image quality is not deteriorated. Therefore, high-speed recording and high-quality recording can be accomplished at the same time. Further, in this embodiment mode, a liquid droplet is ejected from each ejection orifice to each ejection area, and thus, it is not necessary to increase the number of recorded data. A complicated data configuration is not necessary, and thus, the cost can be reduced.

According to this embodiment, a liquid droplet is ejected in divided multiple ejection areas in one pixel area so that the total amount of the liquid droplets ejected in one pixel area is equal to or larger than a specified amount (equal to or larger than an ejection amount necessary for filling one pixel area). The arrangement density of the ejection orifices, the number of liquid droplets ejected in one pixel area, the liquid amount of each liquid droplet, and the like may be arbitrarily set. In particular, when liquid droplets are ejected in one pixel area corresponding to 600 dpi, it is desired that the relationship $A/12 \leq b \leq 25 - A/5$ be satisfied, where b represents the ejection amount and A represents the moving speed of the carriage. In this case, the moving speed of the carriage is preferably in a range of 40 inch/s to 80 inch/s (1.016 m/s to 2.032 m/s), more preferably in a range of 50 inch/s to 70 inch/s (1.27 m/s to 1.778 m/s). It is preferred that the multiple liquid droplets ejected in one pixel area be ink of similar colors.

A liquid ejection head to which the above-mentioned liquid ejection recording method is applied according to embodiments of the present invention is described in the following.

Embodiment 1

Figure 5:
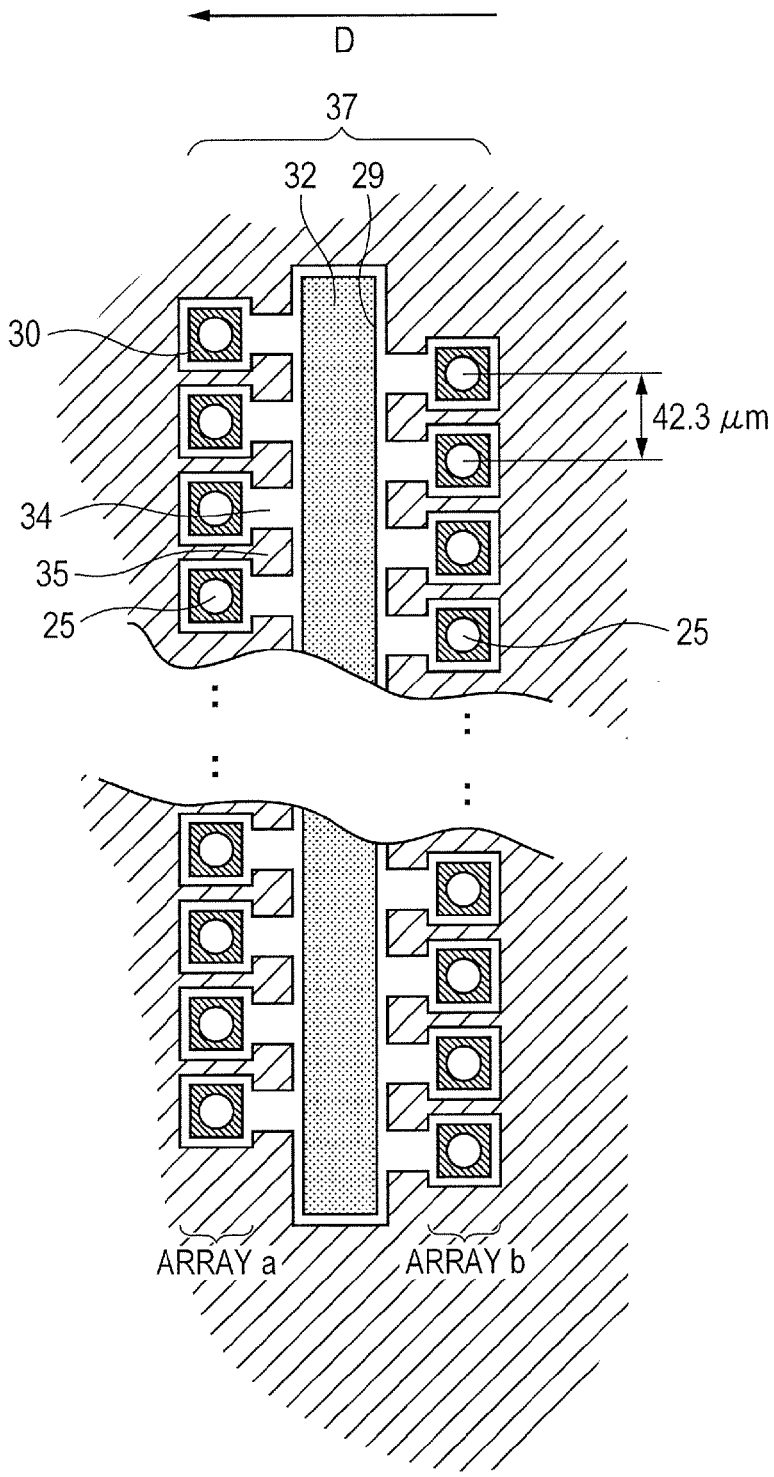
FIG. 5 illustrates a liquid ejection head of Embodiment 1 of the present invention seen from an ejection orifice side.

FIG. 5 illustrates a liquid ejection head of this embodiment seen from the ejection orifice side. The liquid ejection head illustrated in FIG. 5 is mounted on a carriage (not shown) which moves in the scan direction D (see FIG. 5) set in advance. The liquid ejection head ejects liquid droplets during the movement of the carriage.

As illustrated in FIG. 5, the liquid ejection head of this embodiment includes an ejection orifice group 37. The ejection orifice group 37 includes a first ejection orifice array "a" and a second ejection orifice array "b". In each ejection orifice array, 512 ejection orifices 25 are arranged in an arrangement direction intersecting the scan direction D at predetermined intervals (42.3 μm, corresponding to 600 dpi). An electrothermal converter 30 is provided at a position opposed to each ejection orifice 25. The second ejection orifice array "b" is adjacent to the first ejection orifice array "a" in the scan direction. The ejection orifices 25 in the second ejection orifice array "b" are offset by half the interval between the arranged ejection orifices in the arrangement direction with respect to the ejection orifices 25 in the first ejection orifice array "a". Therefore, the arrangement density of the ejection orifices 25 in the ejection orifice group 37 is 1,200 dpi. The distance between the first ejection orifice array "a" and the second ejection orifice array "b" is 0.25 mm.

A liquid supply port 29 is formed between the first ejection orifice array "a" and the second ejection orifice array "b". The liquid supply port 29 communicates with the ejection orifices 25 through liquid flow paths 34. The liquid flow paths 34 are separated from one another by walls 35. Liquid (ink) is supplied to the liquid supply port 29 from a common liquid chamber 32. The liquid supply port 29 supplies liquid to the ejection orifices 25 through the liquid flow paths 34.

In the liquid ejection head of this embodiment, by adjusting the resistor of the electrothermal converter on the front side and the resistor of the electrothermal converter 30 on the rear side, the ejection velocity of a liquid droplet is set to be 12 to 15 m/s. The liquid amount of a liquid droplet is determined by adjusting the diameter of the ejection orifice and the size of the electrothermal converter 30. In this embodiment, rectangular electrothermal converters 30 of 21×37 μm are used, and the liquid amount is 12 pl. In this embodiment, following the ejection of a liquid droplet from an ejection orifice 25 in the first ejection orifice array "a" toward the ejection area S1 (first ejection area) in the one pixel area S, an ejection orifice 25 in the second ejection orifice array "b" ejects a liquid droplet toward the ejection area S2 (second ejection area) (see FIG. 1B).

Embodiment 2

A liquid ejection head of this embodiment includes two ejection orifice groups 37 illustrated in FIG. 5. Specifically, the liquid ejection head of this embodiment has four ejection orifice arrays which are twice as much as those in Embodiment 1. The arrangement density of the ejection orifices 25 is 1,200 dpi. Rectangular electrothermal converters 30 of 21×27 μm are used. The liquid amount of a liquid droplet is 6 pl. In this embodiment, the ejection orifices 25 in the ejection orifice arrays continuously eject four liquid droplets in one pixel area.

Comparative Example 1

A liquid ejection head of this comparative example includes, similarly to the case of Embodiment 1, the ejection orifice group 37 including two ejection orifice arrays. However, the number of the ejection orifices 25 in each ejection orifice array is 256. The intervals between the ejection orifices 25 and between the electrothermal converters 30 are 84.7 μm (corresponding to 300 dpi). Therefore, in this comparative example, the arrangement density of the ejection orifices 25 is 600 dpi. In this comparative example, square electrothermal converters 30 of 36×36 μm are used and the liquid amount of a liquid droplet is 24 pl. In this embodiment, as illustrated in FIG. 1A, one liquid droplet is ejected in one pixel area S.

Comparative Example 2

In this comparative example, four ejection orifice groups 37 illustrated in FIG. 5 are included. More specifically, a liquid ejection head of this comparative example has eight ejection orifice arrays which are twice as much as those in Embodiment 2. The arrangement density of the ejection orifices 25 is 1,200 dpi. Rectangular electrothermal converters 30 of 16×27 μm are used. The liquid amount of a liquid droplet is 3 pl. In this comparative example, the ejection orifices 25 in the ejection orifice arrays continuously eject eight liquid droplets in one pixel area.

Evaluation

The liquid ejection heads of the above-mentioned Embodiments 1 and 2 and Comparative Examples 1 and 2 were each mounted on a carriage having a moving speed of 50 inch/s (1.27 m/s) and the quality of images formed thereby on an A4-size plain paper sheet was evaluated. The distance between the plain paper sheet and the ejection orifices 25 was 1.5 mm, and an ink having a specific gravity of 1.05, a viscosity of 0.0024 (Pa·s), and a surface tension of $4\times10^{-4}$ N/cm$^2$ was used. In evaluating the quality of the images, an image formed by the liquid ejection head of Comparative Example 1 having a conventional structure under recording conditions in which the liquid ejection head was mounted on a carriage having a moving speed of 25 inch/s (0.635 m/s) was used as a reference image. In the evaluation, when the quality of an image is equal to the quality of the reference image, the image was evaluated as OK, and when the quality is worse, the image was evaluated as NG. The results were that the images formed by the liquid ejection heads of Embodiments 1 and 2 were OK, while the images formed by the liquid ejection heads of Comparative Examples 1 and 2 were NG. Specifically, the image formed by the liquid ejection head of Comparative Example 1 was a ghost printed image in which the contour of a letter was doubled. The image formed by the liquid ejection head of Comparative Example 2 was a blurred image having a fogged unclear letter edge.

Embodiment 3

Figure 6:
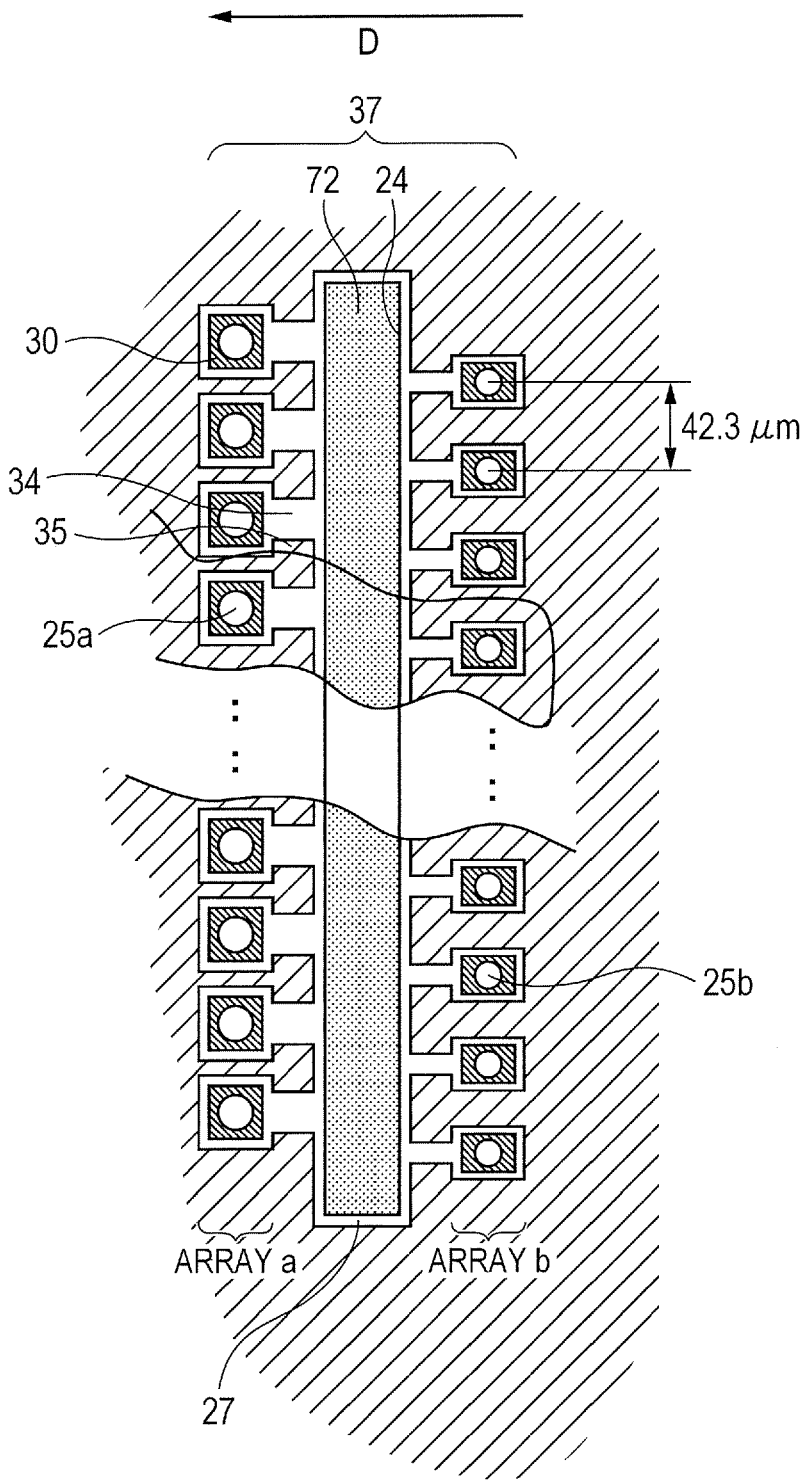
FIG. 6 illustrates a liquid ejection head of Embodiment 3 of the present invention seen from the ejection orifice side.

FIG. 6 illustrates a liquid ejection head of this embodiment seen from the ejection orifice side. In the liquid ejection heads of Embodiments 1 and 2, as illustrated in FIG. 5, the diameters of all the ejection orifices 25 in the ejection orifice group 37 are the same and the liquid amount is uniform. In this embodiment, the diameter of ejection orifices 25*a* in the first ejection orifice array "a" is different from the diameter of ejection orifices 25*b* in the second ejection orifice array "b". Specifically, as illustrated in FIG. 6, the diameter of the ejection orifices 25*b* is smaller than the diameter of the ejection orifices 25*a*.

In this embodiment, the liquid amount of a liquid droplet ejected from the ejection orifice 25*a* is 12 pl, while the ejection amount of a liquid droplet ejected from the ejection orifice 25*b* is 8 pl. The liquid droplet from the ejection orifice 25*a* and the liquid droplet from the ejection orifice 25*b* are ejected in the one pixel area S.

Embodiment 4

Figure 7:
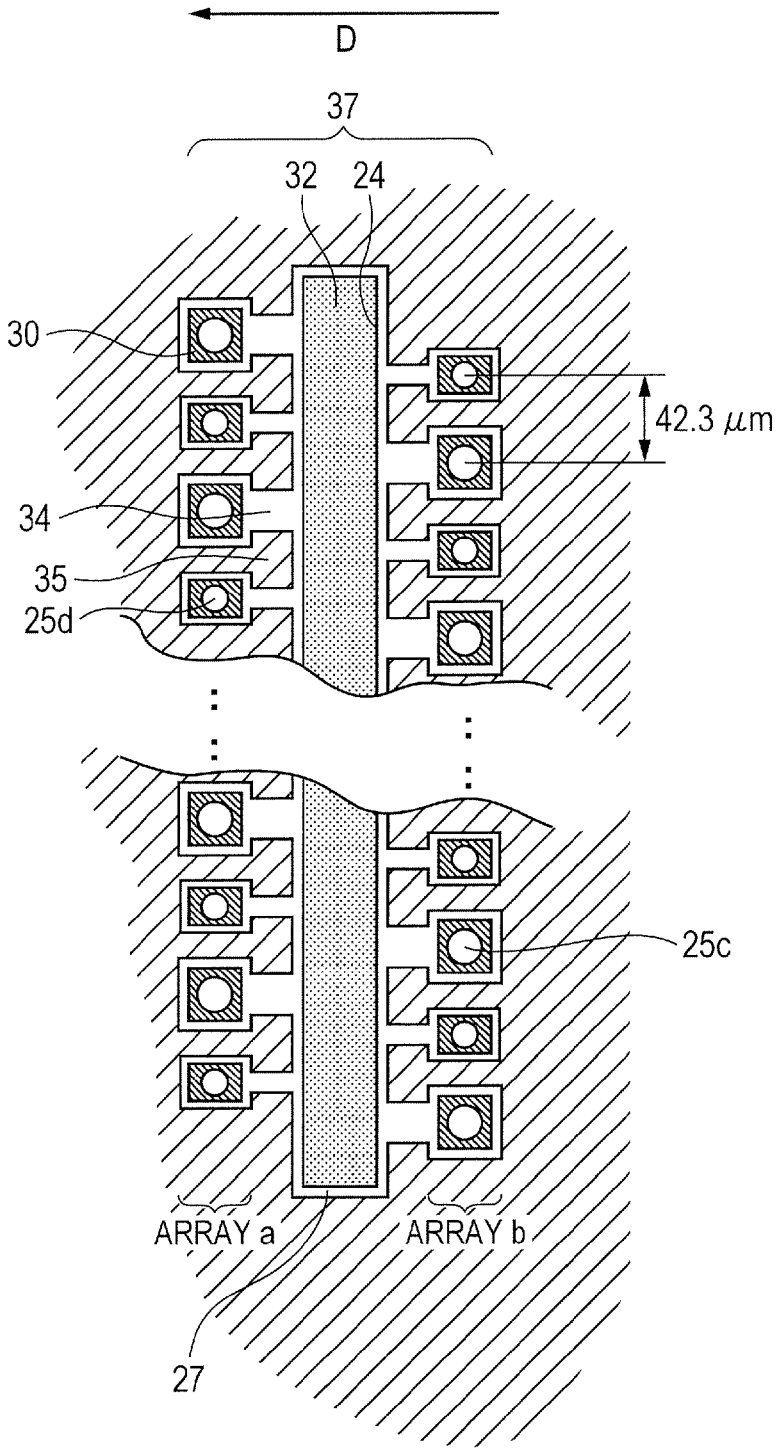
FIG. 7 illustrates a liquid ejection head of Embodiment 4 of the present invention seen from the ejection orifice side.

FIG. 7 illustrates a liquid ejection head of this embodiment seen from the ejection orifice side. Similarly to the case of the above-mentioned Embodiment 1, the liquid ejection head of this embodiment has the ejection orifice group 37 including two ejection orifice arrays. However, in this embodiment, in the first ejection orifice array "a" and in the second ejection orifice array "b", first ejection orifices 25*c* which eject liquid droplets in the ejection amount of 12 pl and second ejection orifices 25*d* which have a diameter smaller than that of the first ejection orifices 25*c* and which eject liquid droplets in the ejection amount of 8 pl are staggered. Specifically, the first ejection orifices 25*c* and the second ejection orifices 25*d* are alternately arranged in the scan direction D and in the arrangement direction.

In this embodiment, similarly to Embodiment 3, the liquid droplet from the first ejection orifice 25*c* and the liquid droplet from the second ejection orifice 25*d* are ejected in the one pixel area S.

Figure 8A:
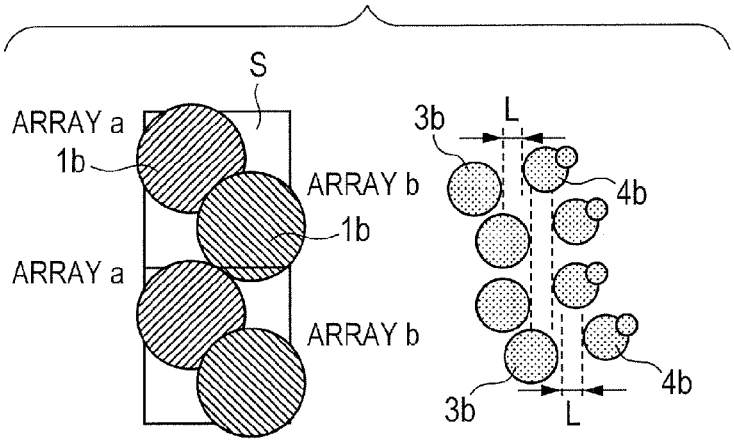
FIGS. 8A, 8B and 8C are comparative views illustrating the impact states of liquid droplets with regard to the liquid ejection heads of Embodiments 1, 3, and 4, respectively.
Figure 8B:
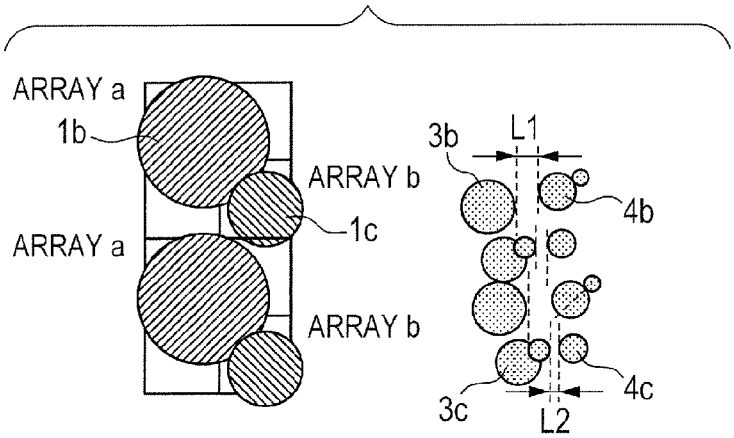
Figure 8C:
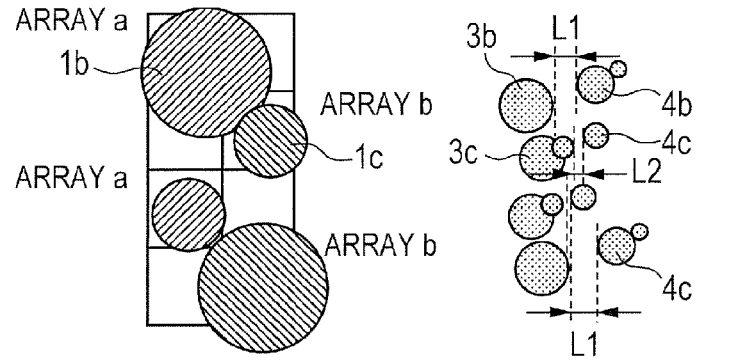

FIGS. 8A to 8C are comparative views illustrating the impact states of liquid droplets with regard to the liquid ejection heads of Embodiments 1, 3, and 4, respectively. FIG. 8A illustrates the impact state of liquid droplets ejected from the liquid ejection head of Embodiment 1. FIG. 8B illustrates the impact states of liquid droplets ejected from the liquid ejection head of Embodiment 3. FIG. 8C illustrates the impact state of liquid droplets ejected from the liquid ejection head of Embodiment 4. In FIGS. 8A to 8C, the moving speed of the carriage is 50 inch/s (1.27 m/s).

When FIG. 8A and FIG. 8B are compared, in the liquid ejection head of Embodiment 3, compared with the liquid ejection head of Embodiment 1, a white non-image area in the one pixel area S caused by impact deviation of a satellite is inconspicuous. The liquid ejection head of Embodiment 1 ejects, in the one pixel area S, the two liquid droplets 1*b* each having an ejection amount of 12 pl. On the other hand, the liquid ejection head of Embodiment 3 ejects, in the one pixel area S, the liquid droplet 1*b* having an ejection amount of 12 pl and the liquid droplet 1*c* having an ejection amount of 8 pl. As described above, the impact deviation of a satellite with respect to a main droplet becomes smaller as the liquid droplet becomes smaller (as the ejection amount becomes smaller) (see L1 and L2 in FIGS. 8A to 8C). Therefore, compared with the liquid ejection head of Embodiment 1, the liquid ejection head of Embodiment 3 can improve the image quality.

When FIG. 8A and FIG. 8C are compared, in the liquid ejection head of Embodiment 4, compared with the liquid ejection head of Embodiment 1, a white non-image area in the one pixel area S caused by impact deviation of a satellite is inconspicuous. This is because, similarly to the case of the liquid ejection head of Embodiment 3, the liquid ejection head of Embodiment 4 ejects the liquid droplet 1*b* and the liquid droplet 1*c* in the one pixel area S. Therefore, compared with the liquid ejection head of Embodiment 1, the liquid ejection head of Embodiment 4 can improve the image quality. Further, in the liquid ejection head of Embodiment 4, the ejection orifices are arranged so that ejection orifices having larger diameters are not adjacent to each other. Therefore, compared with the liquid ejection head of Embodiment 3 in which ejection orifices having larger diameters are adjacent to each other, the effect of inhibiting crosstalk can be enhanced.

Embodiment 5

Figure 9:
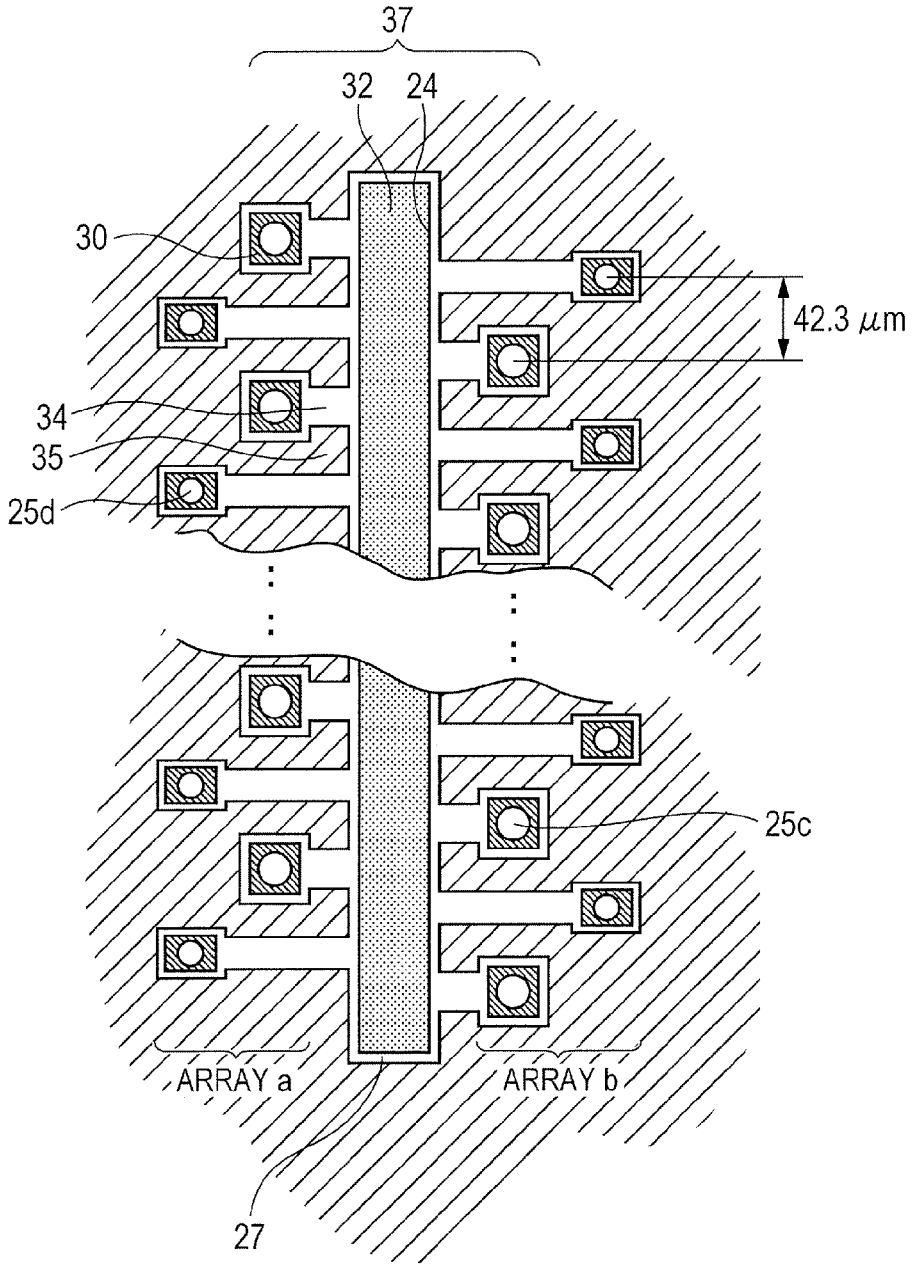
FIG. 9 illustrates a liquid ejection head of Embodiment 5 of the present invention seen from the ejection orifice side.
Figure 10A:
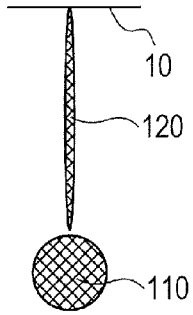
FIGS. 10A, 10B, 10C, 10D, 10E, 10F and 10G illustrate states from when an ink droplet is ejected to when the ink droplet impacts on a recording medium.
Figure 10B:
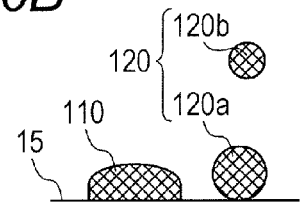
Figure 10E:
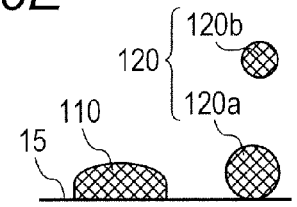
Figure 10C:
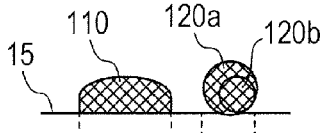
Figure 10F:
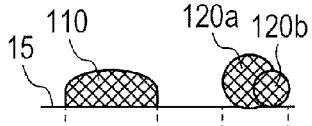
Figure 10D:
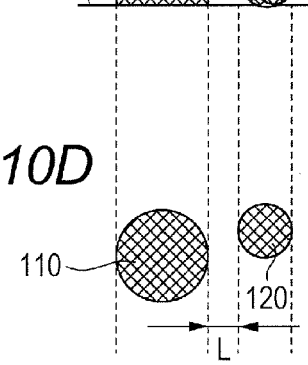
Figure 10G:
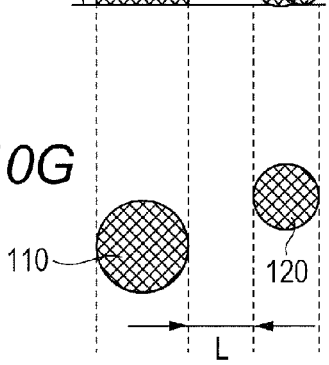
Figure 11A:
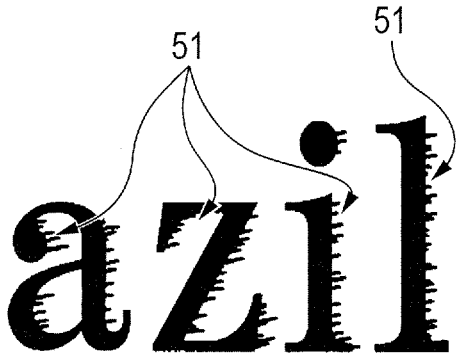
FIGS. 11A and 11B illustrate image quality deterioration involved in high-speed movement of the carriage.
Figure 11B:
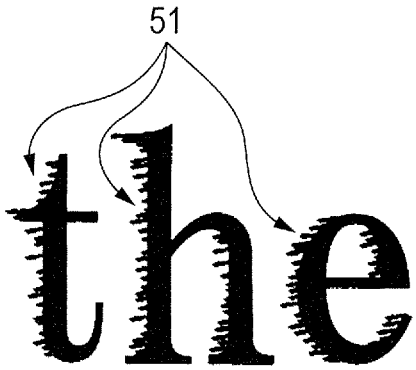

FIG. 9 illustrates a liquid ejection head of this embodiment seen from the ejection orifice side. In the following, features different from those of the liquid ejection head of Embodiment 4 are mainly described. As illustrated in FIG. 9, in the liquid ejection head of this embodiment, in each ejection orifice array, the first ejection orifices 25*c* and the second ejection orifices 25*d* are offset from each other in the scan direction. Further, the second ejection orifices 25*d* are farther from the liquid supply port 29 than the first ejection orifices 25*c*. More specifically, in this embodiment, the first ejection orifices 25*c* are provided nearer to the liquid supply port 29, and the second ejection orifices 25*d* are provided farther from the liquid supply port 29. As the distance from the liquid supply port 29 becomes larger, the time necessary for refilling the ejection orifice becomes longer, but, in this embodiment, ejection orifices having smaller diameters are provided farther from the liquid supply port 29. Therefore, the refill time can be reduced to be able to accommodate high frequency drive.

In the above-mentioned embodiments, description is made with regard to a case in which the liquid ejection head is mounted on a carriage and the carriage moves with respect to a recording medium to perform recording, but the present invention is not limited thereto. The present invention may also be applied to a so-called full-line type recording apparatus in which a liquid ejection head having a length corresponding to the width of a recording medium is fixed, and which performs recording while the recording medium is moved. In this case, the above-mentioned "moving speed of the carriage" can be replaced with "relative speed between the liquid ejection head and the recording medium."

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-046423, filed Mar. 2, 2012, which is hereby incorporated by reference herein in its entirety.

What is claimed is:

1. A method for recording by ejecting liquid to a recording medium, the method comprising:

preparing a liquid ejection head including an ejection orifice array in which multiple ejection orifices for ejecting the liquid are arranged, the multiple ejection orifices including a larger-diameter ejection orifice for ejecting liquid droplets in a predetermined amount from 5 pl or more to 15 pl or less and a smaller-diameter ejection orifice for ejecting liquid droplets in an amount from 5 pl or more to 15 pl or less and smaller than the predetermined amount; and ejecting multiple black liquid droplets from the multiple ejection orifices while the recording medium and the liquid ejection head move at a relative speed from 50 inch/sec or more to 70 inch/s or less to fill a predetermined pixel area on the recording medium with the multiple liquid droplets, wherein the larger-diameter ejection orifice and the smaller-diameter ejection orifices eject the liquid droplets to fill an area corresponding to a diagonal line of the pixel on the recording medium.

2. The method according to claim 1, wherein the liquid ejection head is mounted on a carriage that reciprocates with respect to the recording medium.

3. The method according to claim 1, wherein the liquid ejection head is a full-line type liquid ejection head having a length corresponding to a width of the recording medium, and the recording medium moves with respect to the liquid ejection head.

4. The method according to claim 1, wherein an arrangement density of the multiple ejection orifices forming the ejection orifice array is 600 dpi or more.

5. The method according to claim 1, wherein the predetermined pixel area on the recording medium is defined by a lattice corresponding to 600 dpi.

6. The method according to claim 1, wherein a total amount of the multiple liquid droplets that fill the predetermined pixel area is 20 pl or more.

7. A method for recording by ejecting liquid to a recording medium, the method comprising:

preparing a liquid ejection head including an ejection orifice array in which multiple ejection orifices for ejecting the liquid are arranged, the multiple ejection orifices including a larger-diameter ejection orifice for ejecting liquid droplets in a predetermined amount from 5 pl or more to 15 pl or less and a smaller-diameter ejection orifice for ejecting liquid droplets in an amount from 5 pl or more to 15 pl or less and smaller than the predetermined amount; and ejecting multiple black liquid droplets from the multiple ejection orifices while the recording medium and the liquid ejection head move at a relative speed from 50 inch/sec or more to 70 inch/sec or less to fill a pixel area on the recording medium with the multiple liquid droplets, the pixel area being defined by a lattice corresponding to 600 dpi, wherein the larger-diameter ejection orifice and the smaller-diameter ejection orifices eject the liquid droplets to fill an area corresponding to a diagonal line of the pixel on the recording medium.

8. The method according to claim 7, wherein an arrangement density of the multiple ejection orifices forming the ejection orifice array is 600 dpi or more.

9. The method according to claim 7, wherein the liquid ejection head is mounted on a carriage that reciprocates with respect to the recording medium.

10. The method according to claim 7, wherein the liquid ejection head is a full-line type liquid ejection head having a length corresponding to a width of the recording medium, and the recording medium moves with respect to the liquid ejection head.

11. A method for recording by ejecting liquid to a recording medium, the method comprising:

preparing a liquid ejection head including an ejection orifice array in which multiple ejection orifices for ejecting the liquid are arranged, the multiple ejection orifices including a larger-diameter ejection orifice for ejecting liquid droplets in a predetermined amount from 5 pl or more to 15 pl or less and a smaller-diameter ejection orifice for ejecting liquid droplets in an amount from 5 pl or more to 15 pl or less and smaller than the predetermined amount; and ejecting multiple black liquid droplets from the multiple ejection orifices while the recording medium and the liquid ejection head move at a relative speed from 50 inch/sec or more to 70 inch/sec or less to fill a predetermined pixel area on the recording medium with the multiple liquid droplets, wherein a total amount of the multiple liquid droplets that fill the predetermined pixel area is 20 pl or more, and the larger-diameter ejection orifice and the smaller-diameter ejection orifices eject the liquid droplets to fill an area corresponding to a diagonal line of the pixel on the recording medium.

12. The method according to claim 11, wherein an arrangement density of the multiple ejection orifices forming the ejection orifice array is 600 dpi or more.

13. The method according to claim 11, wherein the liquid ejection head is mounted on a carriage that reciprocates with respect to the recording medium.

14. The method according to claim 11, wherein the liquid ejection head is a full-line type liquid ejection head having a length corresponding to a width of the recording medium, and the recording medium moves with respect to the liquid ejection head.

* * * * *